US006481590B1

(12) United States Patent
Simkins

(10) Patent No.: US 6,481,590 B1
(45) Date of Patent: Nov. 19, 2002

(54) CONTAINER CARRIER

(75) Inventor: Nelson Simkins, Rittman, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/675,643

(22) Filed: Sep. 29, 2000

(51) Int. Cl.[7] ..... B65D 23/12

(52) U.S. Cl. ..... 215/399; 215/397; 215/12.1; 248/311.3; 248/312

(58) Field of Search ..... 215/399, 397, 215/121, 386; 248/311.3, 312, 318; 220/481

(56) References Cited

U.S. PATENT DOCUMENTS 986,963 A * 3/1911 Breitung ..... 215/12.1
1,783,765 A * 12/1930 Anderssen ..... 215/399
2,930,502 A 3/1960 Klein
2,982,434 A * 5/1961 Hidding ..... 215/399
3,220,591 A * 11/1965 Hidding ..... 215/399
3,366,360 A * 1/1968 Burke ..... 248/318
3,395,882 A * 8/1968 Marshall ..... 215/12.1
3,537,498 A * 11/1970 Amand ..... 215/386
3,610,671 A 10/1971 Conger
3,630,477 A * 12/1971 Stadler ..... 248/318
3,688,935 A 9/1972 Owen et al.
3,807,679 A 4/1974 Burke et al.
3,865,339 A 2/1975 Von Alven
3,913,879 A * 10/1975 Wright, Jr. ..... 248/318
4,168,783 A 9/1979 Gargione
4,371,087 A 2/1983 Saujet
4,413,741 A * 11/1983 Curchack ..... 215/399
4,892,206 A * 1/1990 Perrin ..... 215/12.1
5,125,521 A * 6/1992 Somogyi ..... 215/12.1
5,299,700 A 4/1994 Beniacar
5,648,757 A 7/1997 Vernace et al.
6,199,719 B1 * 3/2001 Bordage ..... 215/399

FOREIGN PATENT DOCUMENTS

FR 2430763 * 7/1978 ..... B61J/9/06

* cited by examiner

*Primary Examiner*—Stephen P. Garbe
*Assistant Examiner*—Tri M. Mai
(74) *Attorney, Agent, or Firm*—Reese Taylor

(57) ABSTRACT

A carrier for a container capable of attachment to a strap, key ring or other support includes a flexible body sized so as to releasably receive the container. The body has a loop or hook projecting from one end for engagement with the support and a through opening in the opposed end for receipt of the neck of the container.

7 Claims, 2 Drawing Sheets

CONTAINER CARRIER

FIELD OF THE INVENTION

This invention relates in general to a carrier or case for releasable receipt of a container and relates more particularly to such a carrier capable of releasably receiving a liquid bearing container for dispensing a liquid such as soap or a hand sanitizing composition, which carrier is provided with means for attachment to support elements of varying types.

BACKGROUND OF THE INVENTION

It is known that hand sanitation is becoming extremely important for the control of disease. Means for sanitizing the hands are provided to users in a variety of ways ranging from permanently affixed wall-mounted dispensers to counter top dispensers and to relatively small containers which can be carried on the person of the individual for ready access.

This particular invention is primarily directed to a carrier for the later type, i.e., the relatively small personal size container.

Currently in this field, the smaller containers are provided in sizes containing one, two, or three ounces of a sanitizing composition and intended to be carried, for example, in the purse or pocket of the user. In addition to limiting access, or at least making access more difficult, it is always possible to overlook the fact that one even has such a container and that such a sanitizing composition is readily available. Therefore, it is desirable to provide a carrier into which the relatively small container can be inserted and used and also to provide one which permits the container to be easily replaced when its contents are exhausted.

Applicant is not aware of any container carriers in the prior art which would accommodate such a desirable result.

Vernace U.S. Pat. No. 5,648,757 shows a two-piece elastic frame for placement around a TV remote control device, which is indeed flexible and can be pried on or off of the remote control. Klein U.S. Pat. No. 2,930,502 is also of interest in this regard showing a C-shaped plastic handle and holder for engaging the neck of a plastic cosmetic bottle which in turn can be easily snapped into and removed from the handle. Conger U.S. Pat. No. 3,610,671 shows a similar handle-type device which can be snapped over the bottle.

Some of the prior art also shows elastic members which can be attached to one end only of a container which have eyes or hooks for purposes of hanging the same. Examples can be seen in Gargione U.S. Pat. No. 4,168,783; Owen U.S. Pat. No. 3,688,935 and Burke U.S. Pat. No. 3,807,679.

None of these, however, provide means for engaging the bottle snugly and safely by fully encompassing the periphery of the bottle together with providing means for attaching the carrier to a support surface such as a key ring, the users belt or the strap of a diaper bag, etc. Furthermore, none disclose means for so encompassing or carrying the container with the dispensing neck or nozzle of the bottle readily available for use by the person employing it without removing it from the carrier. It is therefore thought desirable to incorporate all of these features into a single carrier so as to both facilitate access to it and encourage the use of the sanitizing composition contained in the container.

BRIEF SUMMARY OF THE INVENTION

It has accordingly been found that providing a carrier which comprises an elongate, flexible body having first and second ends with attachment means projecting from a first end of the body and an opening in the opposed end for the neck of the container that the principal object of the invention can be achieved.

It has been found that if the body of the carrier can be made with a hollow interior ribbed so as to snugly engage the bottle when the bottle is snapped into it, that a still further object of the invention can be achieved.

Accordingly, production of an improved carrier for a container becomes the principal object of this invention with other objects thereof becoming more apparent upon a reading of the following specification considered and interpreted in view of the accompanying drawings.

BRIEF DESCRIPTION OF THE PREFERRED EMBODIMENTS

Figure 1:
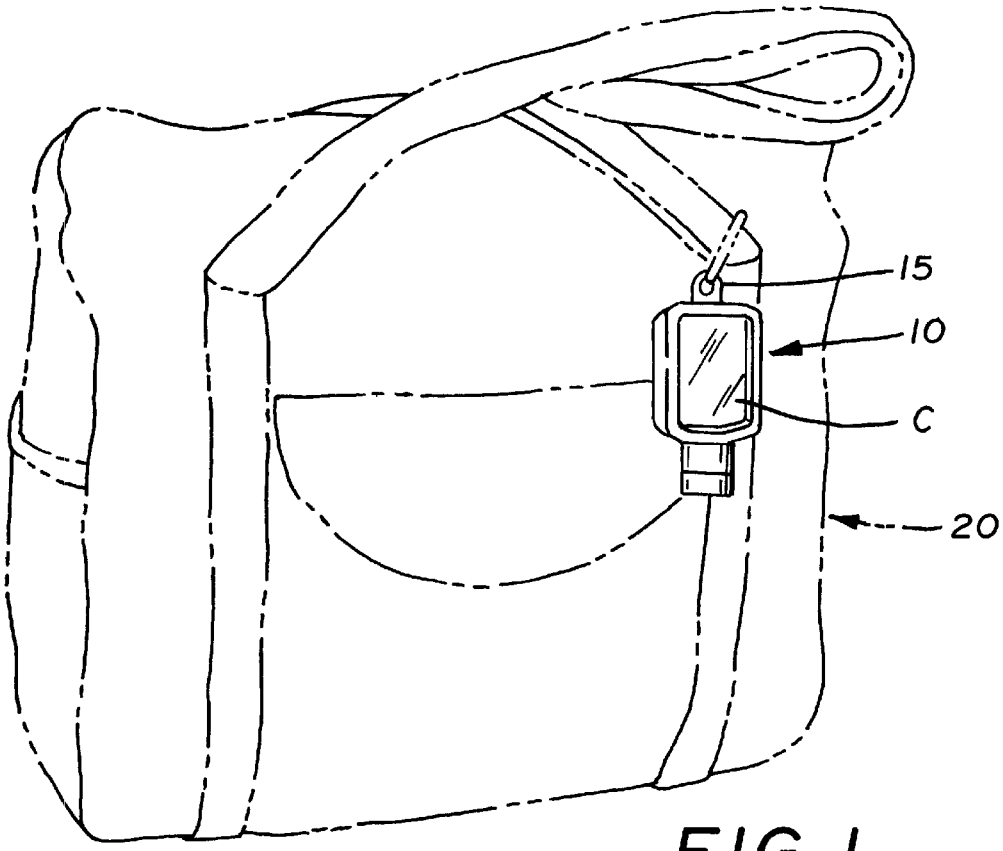
FIG. 1 is a perspective view showing the improved carrier and container attached to a supporting element.

Referring first to FIG. 1 of the drawings, it will be seen that the improved carrier, generally indicated by the numeral 10, is illustrated with the container C enclosed therein and with the carrier attached to the strap of a bag, such as a diaper bag, generally indicated by the numeral 20. The diaper bag 20 is illustrated in the drawing figure merely to show an environment in which the carrier can be used although it will be apparent that the carrier could be used in a wide variety of environments and attached to any number of supporting members, such as, for example a key ring.

Figure 2:
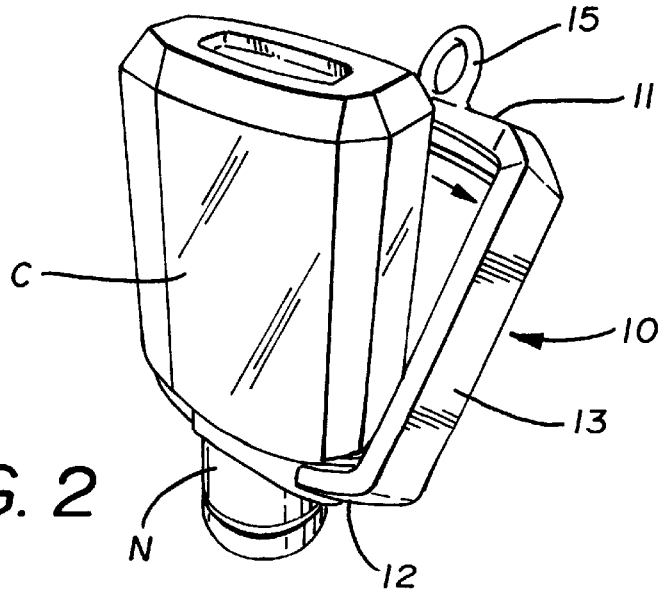
FIG. 2 is a perspective view showing the container partially snapped out of the carrier.
Figure 3:
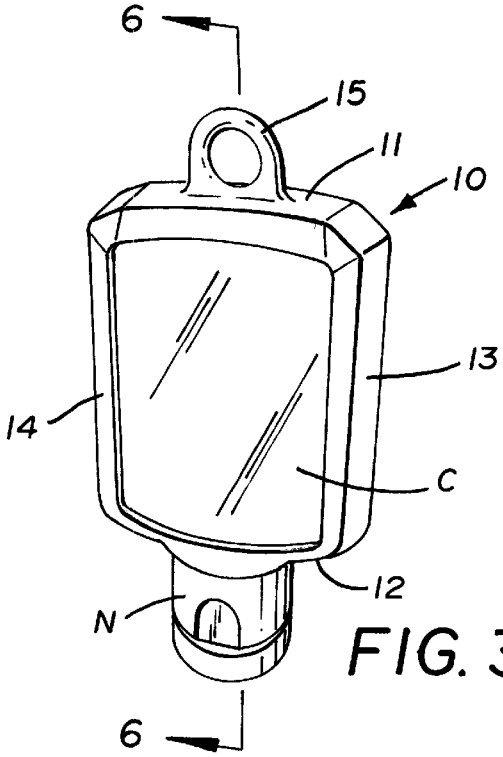
FIG. 3 is a perspective view showing the container fully inserted into the carrier.
Figure 4:
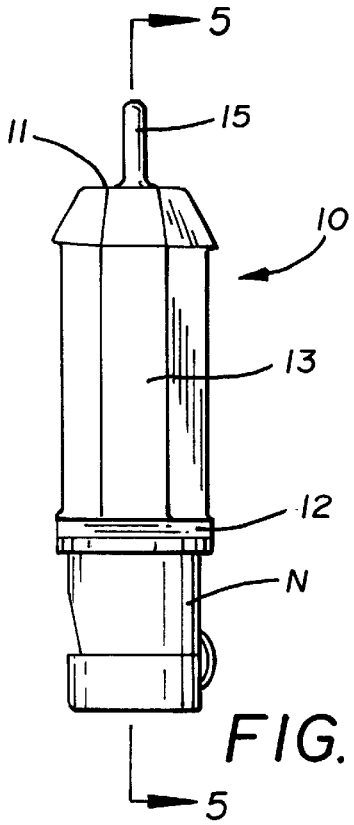
FIG. 4 is a side elevational view of the assembled carrier and container.
Figure 5:
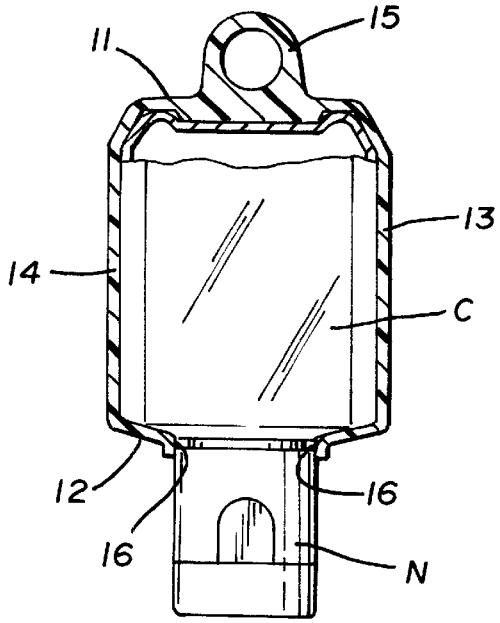
FIG. 5 is a sectional view taken along the line 5—5 of FIG. 4.
Figure 6:
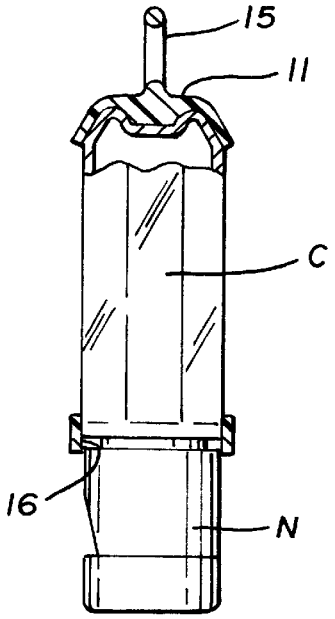
FIG. 6 is a sectional view taken along the line 6—6 of FIG. 3.

Referring to FIGS. 3 through 6 of the drawings for a more detailed description of the carrier, it will be noted that the carrier 10 generally includes a body having a first end 11, a second end 12, and opposed side walls 13 and 14. It is contemplated that the carrier 10 would be fabricated from some sort of suitable elastomeric material and that therefore, the first and second ends 11 and 12 and the side walls 13 and 14 would form a unitary structure which in turn forms a framework having an opening in the interior thereof. As is readily apparent from the drawings, it is intended that the container C can be snapped into and out of this framework as shown in FIG. 2, for example.

Also received on and projecting from the first end 11 of the body of the carrier 10 is an attachment hook or eye designated by the numeral 15. This enables the carrier to be readily attached as shown in FIG. 1 to a variety of supporting elements.

The second end 12 of the carrier body has a through aperture 16 for receipt of the neck N of the bottle or container C as can be seen, for example, in all of the drawing figures. This enables one to snap open the cap of the container or bottle C without disengaging the container C from the carrier 10. In that fashion, the contents of container C can be readily dispensed onto the hand of the user without disengaging the carrier from its support.

In use or operation of the improved carrier, of course, it is merely necessary to snap the container C into the carrier 10 and, if desired, attach it to a support such as the diaper bag 20. When one desires to use the contents of container C one can simply snap open the cap of the container C and dispense the necessary amount of the contents onto the hand or hands. In this fashion, the container and carrier are readily accessible to the user and will not be lost or misplaced.

When the contents of the container C are exhausted, of course, it is simply necessary to snap the empty container C out of the carrier 10 and replace it with a full container.

While a full and complete description of the invention has been set forth in accordance with the dictates of the patent statutes, it should be understood that modifications can be resorted to without departing from the spirit hereof or the scope of the appended claims.

In that regard, it will be noted that a particular type and configuration of container C has been illustrated in the drawings and described herein. Any desirable configuration of the container can be accommodated and the invention is not intended to be limited in that regard.

Also, reference has been made herein to the fact that the invention has particular utility with regard to the dispensing of hand sanitizing material from the container. Again, the unique carrier arrangement and structure should not be considered to be limited to the dispensing of any particular composition from the container, but may well have utility for the dispensing of other materials in addition to hand sanitizing material such as, for example, soap.

Finally, while no particular elastomeric material has been specified herein, it should be noted that any of a number of materials would be appropriate so long as they have sufficient strength to securely retain the container when inserted and sufficient flexibility to permit relatively easy removal and replacement.

What is claimed is:

1. In combination, a carrier and container for receipt therein comprising: a container including:

a) opposed end walls interconnected by opposed side panels and opposed edge walls, and b) a neck portion projecting from one of said end walls; and a carrier including:

a) an elongate flexible, unitary body having 1) opposed first and second end pieces, and 2) opposed side pieces interconnecting said first and second end pieces to form an open frame for engagement with and releasable receipt of said container, said open frame having an interior dimension approximating the exterior dimensions of said end walls and said edge walls of said container and encircling and enclosing said end walls and said edge walls so as to retain said container in said carrier through a friction fit, and b) attachment means disposed on and projecting from one of said end pieces of said carrier.

2. The carrier of claim 1 wherein said attachment means include a closed loop integral with and projecting from said first end piece of said body.

3. The carrier of claim 1 wherein said body is generally hollow so as to form said support frame having an open interior approximating the exterior dimensions of said container.

4. The combination carrier and container of claim 1 or claim 2 wherein said second end piece has a through opening for receipt of said neck portion of said container.

5. The combination carrier and container of claim 1, wherein said opposed side panels of said container may be pressed toward each other to dispense a portion of the contents of said container through said neck portion, and said open frame formed by said carrier allows for access to said opposed side panels of said container, when said container is received in said carrier, such that the contents of said container may be dispensed by pressing said opposed side panels towards each other, when container is received in said carrier.

6. A carrier for a container having top and bottom end walls interconnected by opposed side panels and opposed edge walls to form a substantially closed container with a neck portion projecting from the top wall and attachable to a support element, comprising:

a) a molded, flexible, resilient, unitary body having first and second ends and opposed side walls interconnecting said first and second ends;

b) attachment means projecting from said first end of said body and having a through aperture therein for releasably securing said body to said support element;

c) said second end having a through opening for receipt of the neck portion of the container; and d) said first and second ends and said opposed side walls forming a central cavity the interior dimensions of which approximate the exterior dimensions of at least a portion of the container, 1) whereby said opposed side walls of said body may enclose and encircle the opposed end and edge walls of the container to releasably engage the container through a friction fit.

7. The carrier of claim 6 wherein said attachment means include a closed loop integral with and projecting from said first end of said body.

* * * * *